US009534365B2

(12) United States Patent
Briggs et al.

(10) Patent No.: US 9,534,365 B2
(45) **Date of Patent: *Jan. 3, 2017**

(54) DRAIN CHAIN SYSTEMS AND METHODS FOR CLEANING DRAINS

(71) Applicants: Gifford L. Briggs, Salem, UT (US); Jennifer Briggs, Salem, UT (US)

(72) Inventors: Gifford L. Briggs, Salem, UT (US); Jennifer Briggs, Salem, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/560,056

(22) Filed: Dec. 4, 2014

(65) Prior Publication Data

US 2015/0275489 A1 Oct. 1, 2015

Related U.S. Application Data

(63) Continuation-in-part of application No. 13/485,516, filed on May 31, 2012, now Pat. No. 8,910,322.

(Continued)

(51) Int. Cl.
*E03D 9/00* (2006.01)
*E03C 1/264* (2006.01)

(Continued)

(52) U.S. Cl.
CPC ..... *E03C 1/264* (2013.01); *E03C 1/26* (2013.01); *E03C 1/302* (2013.01); *E03F 5/041* (2013.01)

(58) Field of Classification Search
CPC ..... E03C 1/30; E03C 1/302; E03C 1/264; A47K 1/14; E03D 9/00

(Continued)

(56) References Cited

U.S. PATENT DOCUMENTS 214,983 A 5/1879 Atwater
976,593 A 11/1910 Newsome (Continued)

FOREIGN PATENT DOCUMENTS

BE 500354 1/1951
CN 86202976 7/1987

(Continued)

OTHER PUBLICATIONS

DrainWig, available reference date Jul. 26, 2016 online, http://www.amazon.com/introducing-DrainWig-Catches-prevents-shower/dp/B00DC4E1X8/ref=cm_cr_pr_pb_i.

(Continued)

*Primary Examiner* — Paul R Durand
*Assistant Examiner* — Nicholas Ros
(74) *Attorney, Agent, or Firm* — Workman Nydegger

(57) ABSTRACT

Drain chain systems include a cap connected to a chain. The cap rests on a drain and can include holes to facilitate the passage of water through the cap. The cap can include a decorative shape. The chain is flexible and is placed in the drain, sometimes through a hole in a drain cover. The chain can be detachably connected to the cap by a coupling element to facilitate easy replacement of the chain, or can be integrally connected to the cap. During use, hair gathers on the chain. The chain is pulled out of the drain by the decorative cap positioned over the drain. The chain can be cleaned of entangled hair and reused, or the chain can be discarded with or without the cap, by either leaving the chain connected to the cap or by detaching the chain from the cap and replacing it with a new chain.

20 Claims, 7 Drawing Sheets

Related U.S. Application Data

(60) Provisional application No. 61/596,903, filed on Feb. 9, 2012, provisional application No. 61/968,050, filed on Mar. 20, 2014, provisional application No. 62/047,287, filed on Sep. 8, 2014.

(51) Int. Cl.
*E03C 1/26* (2006.01)
*E03F 5/04* (2006.01)
*E03C 1/302* (2006.01)

(58) Field of Classification Search
USPC ..... 4/256.1, 255.01, 286
See application file for complete search history.

(56) References Cited

U.S. PATENT DOCUMENTS

| | | | | | |
|---|---|---|---|---|---|
| 1,333,433 | A | | 3/1920 | Ignatius | |
| 1,461,317 | A | | 7/1923 | Lebleson | |
| 1,730,083 | A | | 10/1929 | Melfi | |
| 1,935,128 | A | * | 11/1933 | Pullman | E03C 1/264 4/286 |
| 1,935,361 | A | * | 11/1933 | Kaplan | A47K 1/14 4/295 |
| 2,024,475 | A | | 12/1935 | Rossman | |
| 2,097,044 | A | | 10/1937 | Riddle | |
| 2,233,234 | A | * | 2/1941 | Wilson | E03C 1/264 4/291 |
| 2,298,591 | A | | 10/1942 | Ross | |
| 2,506,669 | A | * | 5/1950 | Heuacker | E03C 1/264 220/86.3 |
| 2,909,788 | A | | 10/1959 | Van Der | |
| 3,872,521 | A | * | 3/1975 | Friedman | E03C 1/302 15/104.16 |
| 4,999,858 | A | * | 3/1991 | Wu | E03C 1/26 15/104.33 |
| 5,003,642 | A | | 4/1991 | Robb et al. | |
| 5,251,339 | A | * | 10/1993 | Piskula | A47K 11/10 15/104.32 |
| 5,267,361 | A | | 12/1993 | Lai | |
| 5,546,614 | A | | 8/1996 | King, II | |
| 6,088,843 | A | * | 7/2000 | Francisco | E03C 1/264 4/289 |
| 6,487,729 | B2 | | 12/2002 | Delanzo | |
| D515,184 | S | | 2/2006 | Beall | |
| D519,191 | S | | 4/2006 | Beall | |
| D519,600 | S | | 4/2006 | Beall | |
| D538,191 | S | | 3/2007 | Wilder | |
| D547,423 | S | | 7/2007 | Lindsay | |
| D569,488 | S | | 5/2008 | Lindsay | |
| D603,483 | S | | 11/2009 | Lindsay | |
| D610,227 | S | | 2/2010 | Hunter et al. | |
| 7,861,329 | B2 | * | 1/2011 | Markaj | E03C 1/264 4/289 |
| D651,289 | S | | 12/2011 | Beall | |
| D651,294 | S | | 12/2011 | Beall | |
| D651,295 | S | | 12/2011 | Beall | |
| 8,910,322 | B2 | * | 12/2014 | Briggs | E03C 1/264 4/255.01 |
| 2005/0135979 | A1 | * | 6/2005 | Gootter | A61L 9/01 422/266 |
| 2007/0022527 | A1 | * | 2/2007 | Russo | A47K 7/026 4/606 |
| 2009/0320197 | A1 | | 12/2009 | Turner | |
| 2011/0107506 | A1 | * | 5/2011 | Nasrallah | E03D 1/34 4/378 |
| 2011/0168856 | A1 | | 7/2011 | Tu et al. | |
| 2012/0090084 | A1 | | 4/2012 | Ball | |
| 2013/0205485 | A1 | | 8/2013 | Briggs et al. | |

FOREIGN PATENT DOCUMENTS

| | | |
|---|---|---|
| CN | 2039712 | 6/1989 |
| CN | 2486618 | 4/2002 |
| EP | 1516969 | 3/2005 |
| EP | 1605105 | 12/2005 |
| FI | 112968 | 9/2003 |
| GB | 289356 | 4/1928 |
| GB | 359157 | 10/1931 |
| GB | 778214 | 7/1957 |
| WO | 2013119406 | 8/2013 |

OTHER PUBLICATIONS

DrainWig: Are You Hair Free & Happy, available reference date Apr. 5, 2013 www.drainwig.com.
DrainWig2, available reference date Apr. 10, 2013 online, https://www.facebook.com/pages/DrainWig/346162122150138?sk=timeline&ref=page_internal.
European Search Report for EP13746484 dated Jul. 14, 2015.
Ez Zip Drain Cleaning Tool: http://www.dhgate.com/ez-zip-drain-cleaning-tool-uncolg-drains/r-ff8080812ccfd1b4012cead6dd3a2360.html; Dec. 27, 2011.
International Search Report and Written Opinion for PCT/US2013/023417 dated Apr. 9, 2013.
International Search Report and Written Opinion for PCT/US2015/048052 dated Feb. 1, 2016.
Notice of Allowance dated Oct. 7, 2014 cited in U.S. Appl. No. 13/485,516.
Non-Final Office Action dated Nov. 5, 2014 cited in U.S. Appl. No. 29/487,634.

* cited by examiner

DRAIN CHAIN SYSTEMS AND METHODS FOR CLEANING DRAINS

CROSS-REFERENCE TO RELATED APPLICATIONS

This application is a continuation-in-part application of U.S. patent application Ser. No. 13/485,516, filed May 31, 2012, entitled "DRAIN CHAIN SYSTEMS AND METHODS FOR CLEANING DRAINS," which will issue as U.S. Pat. No. 8,910,322 on Dec. 16, 2014 and which claims the benefit of U.S. Provisional Patent Application Ser. No. 61/596,903, filed Feb. 9, 2012, entitled "DRAIN CHAINS AND METHODS FOR CLEANING DRAINS." This application also claims the benefit of U.S. Provisional Patent Application Ser. No. 61/968,050, filed Mar. 20, 2014, entitled "IMPROVED DRAIN CHAIN SYSTEMS AND METHODS FOR CLEANING DRAINS," and the benefit of U.S. Provisional Patent Application Ser. No. 62/047,287, filed Sep. 8, 2014, entitled "IMPROVED DRAIN RING AND CHAIN SYSTEMS AND METHODS FOR CLEANING DRAINS". All of the foregoing applications are expressly incorporated herein by reference in their entireties.

BACKGROUND OF THE INVENTION

1. The Field of the Invention

The present invention relates to drain cleaning systems and methods for their use.

2. The Relevant Technology

Many different types of drain cleaning systems have been developed to remove hair and other debris from the plumbing of a shower or bath drain. Some systems utilize chemicals that are capable of breaking down clogged debris. Other systems utilize mechanical devices. And, some systems utilize a combination of chemical and mechanical means.

A limitation experienced by some drain cleaning devices is that they can only be used after first removing the drain cap from the drain that is to be cleaned. For example, it may be necessary to position a mechanical device within the plumbing of the drain in order to grab and pull the debris from the drain. However, drain caps are generally configured as course filters that effectively prevent large physical objects (such as mechanical de-clogging devices) from being positioned within the drains until after the corresponding drain caps have been removed.

Other mechanical drain cleaning devices comprise filters that are positioned immediately over and/or around the drain, to catch the debris before it enters the drain. These types of devices, however, can create potential hazards, since they protrude up and away from the drain cap.

Furthermore, even when these types of surface filters can be safely positioned over the drain, they are typically unappealing to look at and require frequent manual cleaning Another problem with many existing systems is their expense, making them impractical to replace and necessitating their frequent (and undesirable) cleaning Chemical de-clogging systems have many drawbacks too. For instance, chemical de-clogging solutions are somewhat expensive, particularly when considering that they only provide temporary results. There is also a general aversion to using chemicals because of the potential health risks associated with the use and storage of the chemicals, as well as the potential physical damage that can be caused by the misuse of the chemicals.

For at least the foregoing reasons, there continues to be a need for new and improved systems that are capable of de-clogging and helping maintain clean drains.

BRIEF SUMMARY OF THE INVENTION

The present invention is generally directed towards new and improved mechanical systems that are capable of being used to de-clog and maintain clog free drains.

Many of the inventive systems of the invention utilize a chain that is capable of being positioned into a drain, sometimes through a hole in a drain cover, and catching or otherwise entangling or securing debris found in the drain. The chain can then be pulled out from the drain along with the entangled debris. In this manner, the chain can be used to de-clog or otherwise clean the drain. Notably, the chain can be pulled from the drain, through a hole in the drain cover, without even having to remove the drain cover.

The chain, which is relatively inexpensive, can then be thrown away and replaced. Alternatively, the chain can be cleaned and reused, if desired.

In some embodiments, the inventive de-clogging drain chain systems include a relatively planar and decoratively shaped cap that is connected to the chain. The decorative cap also, preferably, includes one or more apertures or holes that extend through the cap to facilitate the passage of water through the cap as the cap rests flat against the drain cover and so as to prevent any unnecessary blockage of the drain cover. In some embodiments, the cap is also configured in a decoratively-shaped pattern with one or more decorative colors.

The chain is substantially flexible so as to be capable of being positioned within a plurality of differently-shaped drains and drain covers. In some embodiments, the chain is detachably connected to the cap, so as to facilitate easy removal and replacement of the de-clogging segment of chain. In other embodiments, the chain is integrally connected to the cap or substantially permanently attached to the cap so as to lower manufacturing costs and, in some instances, to facilitate the practical replacement of the entire de-clogging device.

In some embodiments, an intermediate segment/connector is disposed between and connected to each of the cap and the chain. This intermediate segment or connector can include a rigid stem, a flexible stem, a string, a wire, an intermediate chain segment, and/or any other type of connecting mechanism. This connector can be used to maintain a position of a de-clogging device on a drain cover, such as, for example, by placing the connector into one of the holes in the drain cover. This connector also includes a coupling element that operates as a detachable connection point for detachably connecting the chain to the cap. In some instances, the chain also includes a corresponding coupling element that is configured in size and shape to be physically coupled to and decoupled from the coupling element of the intermediate connector.

The chain can be any type of chain having any type of links or interconnected material made of metal, plastic, composites, or other materials which is capable of being used according to the descriptions of the invention. In some instances, the chains are simple interconnecting ball or bead chains, with a plurality of connecting bead links In other embodiments, the chain includes a plurality of interlinking loops or other types of links. The links of the chain can be substantially the same in type and size or the links can vary in type and/or size along different portions of the length of the chain.

In many instances, the hair comes in contact with the chain as the hair floats at the water level of a p-trap within the drain. Hair can become entangled in the chain along different portions of the chain as well, even away from a particular water level.

In some embodiments, the chain is even further configured with a plurality of interactive members positioned along the length of the chain to interact with and catch hair that falls into the drain.

After hair has gathered on the chain, the chain can be pulled out of the drain by pulling up on the decorative cap, for instance, which was previously lying flat on or proximate the drain cover. The chain can be thrown away, with or without the decorative cap, by either leaving the chain connected to the cap or by detaching the chain from the cap. It can be hygienic to replace the chain, by detaching the chain from the decorative cap and by attaching a new chain to the decorative cap.

Disposable and replaceable chains configured to be attached to the decorative cap can be sold separately and/or as part of a kit with the decorative cap. A new chain can then be attached to the cap and positioned in the drain. This embodiment is preferred when the decorative cap is relatively nice and/or expensive as compared to the chain, so that it can be reused.

In some embodiments, the manufacture of the cap and chain can both be relatively inexpensive, so as to facilitate the entire replacement of the cap and chain together. In other embodiments, the chain can be manually cleaned and the chain can be repositioned within the drain.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

The present invention is generally directed towards new and improved mechanical systems that are capable of being used to de-clog and maintain clog free drains. These systems are sometimes referred to herein as de-clogging devices, de-clogging systems, drain chain devices, drain chain systems, and sometimes even more generally as devices or systems.

Many systems of the invention utilize chains that are capable of being positioned within the plumbing of a drain to securely entangle and remove hair and other debris from the drain.

In some embodiments, the inventive systems are configured with a cap that is placed on a drain cover and that is connected to a chain that passes through the drain plumbing via a hole in the drain cover. In these embodiments, the debris secured by the chain is pulled out of the hole in the drain cover with the chain. In other embodiments, the cap is configured to be integrated into the center of the decorative drain cover, and can be used for drains without covers, as a cover replacement, or configured for use with modified covers. One or more chains attached to the drain covers, or modified covers, extend into the drain to entangle the hair in the drain.

In many embodiments, the relatively inexpensive chain(s) can be cleaned of any debris and reused, or replaced by detaching the used chain(s) from the cap.

Some drain chain systems of the invention will now be described with specific reference to the illustrated embodiments shown in FIGS. 1-8.

Figure 1:
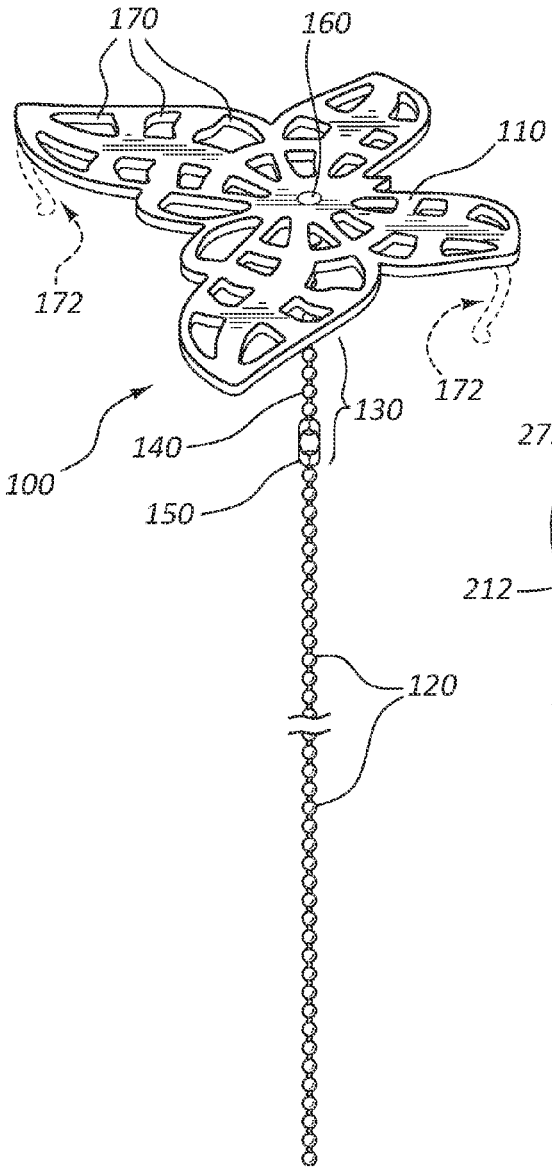
FIG. 1 illustrates one embodiment of a drain chain system that can be used to de-clog and/or help maintain a clean drain, with a butterfly-shaped cap that is configured for placement on a drain cover or drain.

As shown in FIG. 1, a drain chain system 100 is illustrated with a decorative cap 110, a chain 120 comprising a first/de-clogging segment of chain, and an intermediate segment 130 that includes an intermediate segment of chain 140 and a coupling element 150. The intermediate segment 130 is connected to the cap 110 at a mounting point 160.

While the decorative cap 110 is presently shown as a butterfly, it will be appreciated that the specific shape and colors of the decorative cap 110 can vary to accommodate different needs and preferences. The shape and color of the decorative cap 110 can be helpful, in some embodiments, to facilitate detection of the cap 110, and to distinguish it from the drain cover. This can be helpful, for instance, when it is time to clean the drain. The color and decoration of the cap can also provide desired functionality by presenting a visual reminder to periodically clean the drain.

The color of the cap can be a persistent color or a color that changes over time. In one embodiment, the coloring of the cap 110 is provided as a water soluble solution that fades or that is dissolved over time such as, for instance, due to water exposure. In these embodiments, the color of the cap remaining after the solution dissolves, or the absence of the color of the cap as a result of the solution dissolving, can indicate a recommended time to clean the drain and to replace the system with a new system.

The cap can be manufactured out of a variety of different materials, including soft or hard PVC, other plastics, metals such as stainless steel or brass, or other metals, composites, ceramics, or even natural/biodegradable/green materials (e.g., bamboo, coconut shells, sea shells, wood, husks, and so forth). The cap can also be coated with a rubber coating or another coating to facilitate securing the cap in a fixed position over a drain cover with friction of the coating.

The size of the cap can vary from less than an inch to many inches in diameter (e.g. 0.5 inches, 1 or more inches, 2 or more inches, 3 or more inches, 4 or more inches, 5 or more inches, 6 or more inches, or even more). In most embodiments, the footprint of the decorative cap is substantial enough to extend over at least one entire hole and in some instances over many different holes in a drain cover when the cap is placed over the drain cover.

In some embodiments, the thickness of the decorative cap 110 is substantially uniform, in a range from about 0.03125 inches, (1/32 inch), to about 0.1875 inches, (3/16 inch). In other embodiments, the thickness of the decorative cap 110 is not uniform. The thickness of the decorative cap can also be less than 0.03125 inches, (1/32 inch), or more than 0.1875 inches, (3/16 inch), in some embodiments.

Preferably, although not necessarily, the cap is relatively planar (e.g., having a relatively flat top surface and a relatively flat bottom surface). This embodiment can be useful to minimize any potential tripping hazard. However, the cap can also have a curved or hemispheric shape, such that when the cap is placed on a flat object (with the bottom surface of the cap facing down), only a portion of the bottom surface of the cap will touch the flat object. This embodiment is beneficial when the system is being used with drain covers or drain openings that are not flat and such that the cap substantially conforms to the shape of the drain cover/opening.

The cap is also preferably formed with holes or apertures 170 that extend entirely through the cap (e.g., from the top surface to the bottom surface) to facilitate the passage of water through the cap as the cap rests substantially flat against the drain cover/opening and so as to prevent the cap from blocking the flow of water into the drain.

In some embodiments, the holes 170 in the cap are smaller than the holes in the drain cover (e.g., less than about 0.25 inches in diameter), as shown in FIG. 1. With this configuration, the cap can help filter material from the drain. In yet other embodiments, the holes are greater and sometimes substantially greater than the holes in the drain cover.

In one alternative embodiment, the cap comprises a hook 172 that is configured to rest on a structure of a drain cover that separates two holes of the drain cover.

The chain 120, which is connected to the cap (either directly or indirectly from the bottom surface of the cap), contains a plurality of individual links that are connected. The chain 120 is substantially flexible so as to be capable of being positioned within a plurality of differently-shaped drains and drain covers. Even more particularly, the chain is configured in size and shape to pass through a hole in a drain cover, having individual links that are each defined by a size dimension (e.g., diameter, width and/or height) that falls within a range of about 0.125 inches to about 0.25 inches. However, the size dimension of the chain links, in some embodiments, can be less than 0.125 inches and/or greater than about 0.25 inches. The links of the chain can be substantially the same size, along the entire length of the chain, or vary along the length of the chain (e.g., have a greater size at the portion of the chain that is furthest from the cap or, alternatively, in the middle portion of the chain, or a portion of the chain that is nearest the cap, relative to the rest of the chain).

The density of links per inch can vary from very few (e.g., less than five) to very many (e.g., more than five).

The plurality of individual links in the chain, as well as each of the connection points between the links, provide the functionality of being able to catch and secure hair and other debris that falls down a drain. In many instances, the hair comes in contact with the chain as the hair floats at the water level of a p-trap within the drain. In other instances, the hair contacts the chain as the hair falls down the drain, even before reaching the water level of the P-trap.

Figure 2:
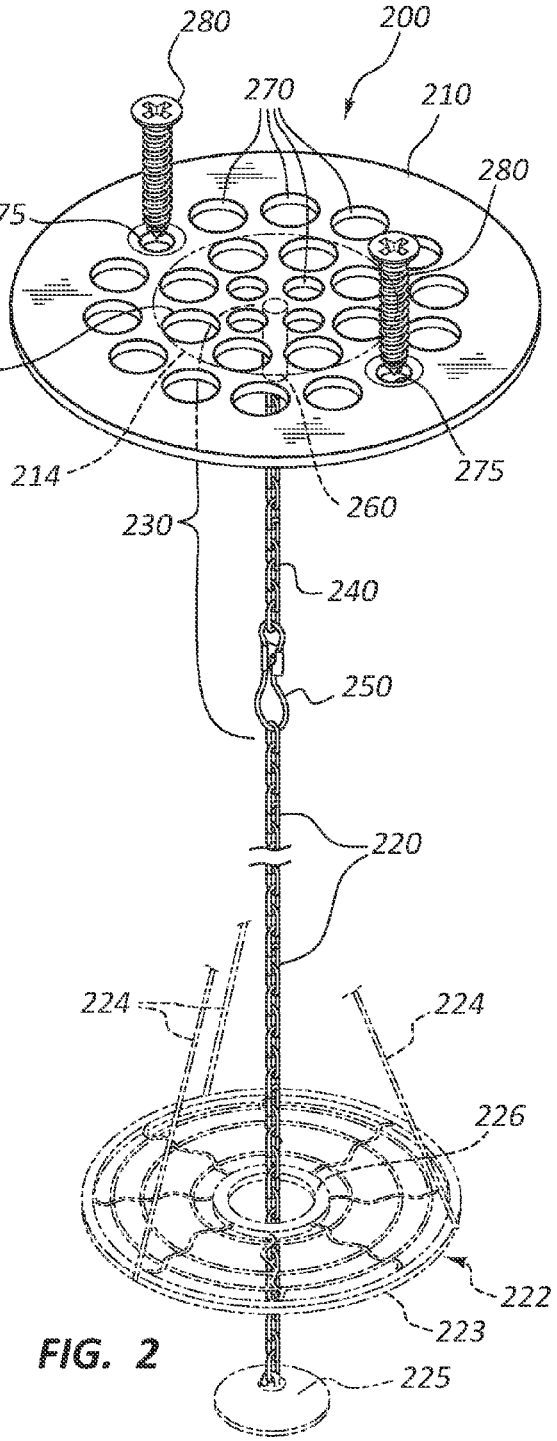
FIG. 2 illustrates one embodiment of a drain chain system that can be used to de-clog and/or help maintain a clean drain, with a substantially planar cap comprising a drain cover that is configured for placement on a drain.

The chains that are used by the invention can be any type of chain having any type of links or interconnected material made of metal, plastic, composites, or other materials which is capable of being used according to the descriptions of the invention. In some instances, the chains are simple interconnecting ball or bead chains, as shown in FIG. 1, with a plurality of connecting bead links. In other embodiments, the chain includes a plurality of interlinking loops or other types of links, as shown in FIG. 2. The chain and links can also comprise materials other than metal and plastic. For instance, in some embodiments, the chain comprises a string, a rope, fabric, or another woven, fibrous or stranded material, composed of natural or synthetic materials (e.g., PVC or Nylon string, shredded plastic, and so forth). In these alternative embodiments, the chain material is still sufficiently flexible to bend or collapse upon itself, under its own weight, without requiring external forces to cause the bending/collapsing.

Because of the functionality of the various links and link connection points, it is not necessary to provide any additional catching mechanisms along the chain. However, as disclosed in more detail below, additional catching mechanisms can still be used with the systems of the invention, if desired. For instance, in some embodiments, the chain 120 is even further configured with a plurality of additional interactive members that can be used to further interact with and catch hair that falls into the drain. This will be described in more detail below with regard to elements 322, 324 and 326 of FIG. 3, as well as element 222 of FIG. 2.

The chain preferably has sufficient flexibility so as to bend and/or collapse under its own weight without requiring any external force to bend the chain, due at least in part to the flexible connections between the links. In other embodiments, at least some external force is required to bend the chain due to substantially rigid/tight connections between the links in the chain. When the chain is composed of a continuous stranded/woven material, the flexibility is provided by the flexibility of the material and/or the weave of the material.

The flexibility of the chain 120 can be beneficial, as discussed below in regard to at least FIG. 3, for allowing the chain 120 to be used in many differently sized drains, even when the chain 120 is longer than the length between a drain cover and the bottom of a p-trap, for instance.

The flexibility of the chain 120 is one distinguishing feature from the prior art devices, such as the hair trap disclosed in European Patent Application EP1605105A1, which utilize substantially rigid members for de-clogging drains. For instance, the hair trap disclosed in European Patent Application EP1605105A1 includes wires that are substantially rigid enough to maintain a bend at lift element (2), as well as to retain the bristles (4) that are held in place by the twining of the metal wires within the elongated body. This configuration requires additional bristles to catch the hair and press it against the body when the body is removed from the drain. This device fails to provide any links to a chain that are each capable of catching the hair and to flexibly bend.

In some embodiments, (not shown), the chain of the present invention can also be replaced with a coarse or fiberous material (e.g., string, cord, a Velcro type material or any other material) that has the flexible properties of a chain and that also includes a plurality of different catch points along the material that are integral to the material itself (e.g., fibers of a string, hooks on a Velcro strip, etc.).

The chain 120 is preferably long enough to extend from the drain cover, on which it rests, to at least the water level in traditional drain plumbing (e.g., the p-trap or other plumbing). This length can be anywhere from a few inches (1-2 inches) to many inches (12-24 or more inches). In some embodiments, the chain 120 can also be extended in length by a connector or intermediate segment 130, as indicated above, that connects the chain 120 to the decorative cap 110 of the de-clogging system.

In many embodiments, the intermediate segment 130 is physically and rigidly connected to the cap 110 and in such a manner that the connector extends laterally away from the bottom surface of the cap 110 in a fixed direction (e.g., substantially perpendicularly away (defining an 80° to a 90° angle with the bottom surface), or at an obtuse angle from the bottom surface). In other embodiments, the connector is hinged to the cap or otherwise flexibly connected to the cap so that it can be adjustably moved to extend from a plurality of different directions from the bottom surface of the cap and to further accommodate placement of the cap on top of differently-shaped drain covers.

In some embodiments the chain 120 is integrally connected to the decorative cap. The integral connection can be formed during manufacture in a casting, drawing, pressing, welding, gluing or other manufacturing process.

In some embodiments, the chain is mechanically coupled to the decorative cap with a snap, ball and hook, ring and hook, clamp, clasp or other interlocking mechanism that is capable of providing the flexibility described above.

The chain 120 in FIG. 1 is detachably connected to the decorative cap 110, with the intermediate segment connector 130, to facilitate easy removal and replacement of the chain with a different chain.

As shown, this connector 130 has an intermediate chain segment 140 that is made of the same type of links and material as chain 120. In other embodiments, however, as shown in FIGS. 4A, 5, 7C and 7D, the intermediate connector 130 can be made of a different material as well, including string, wires, fabric, or other materials. The intermediate connector 130 can be flexible or rigid.

Figure 4A:
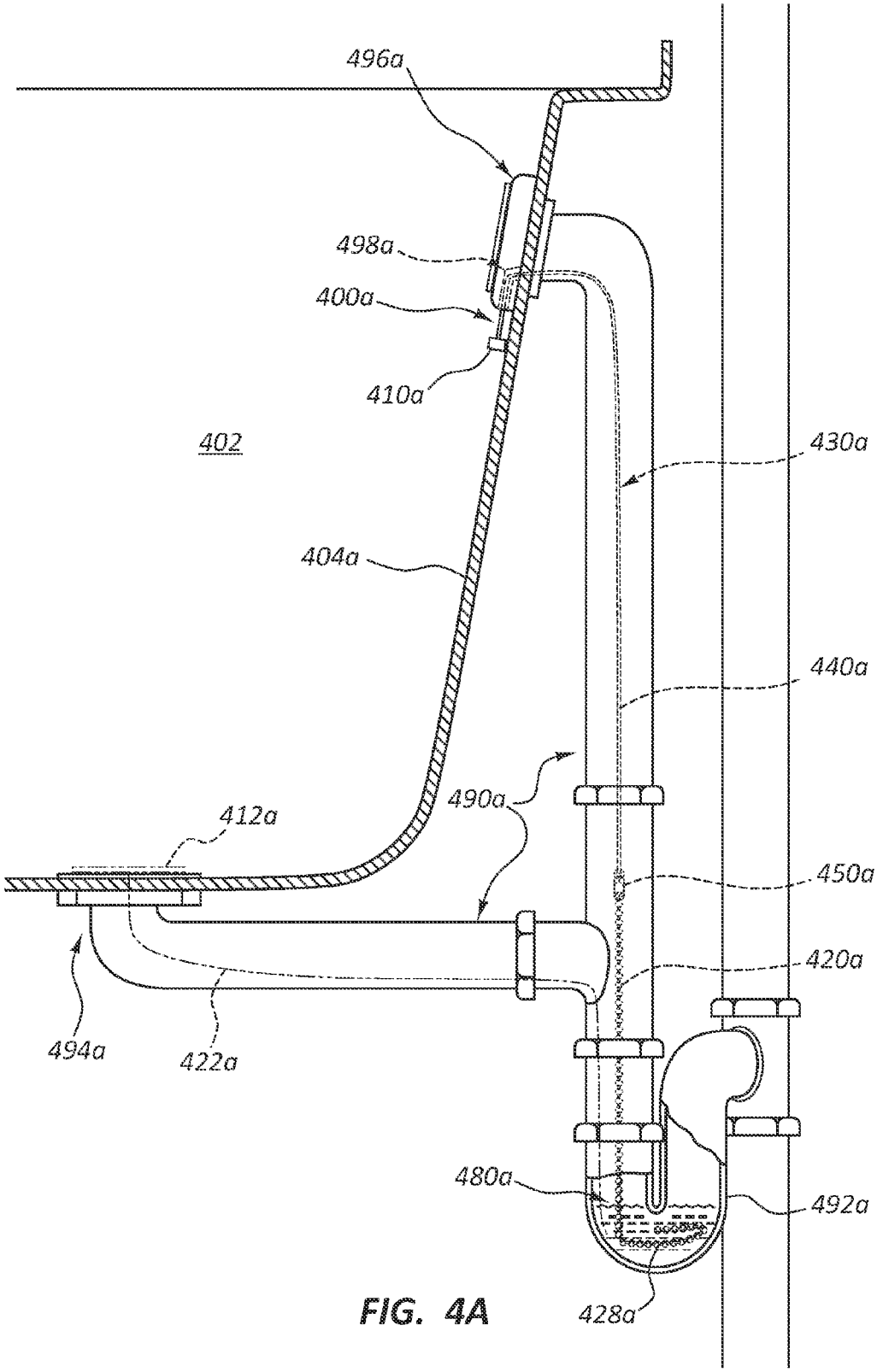
FIG. 4A illustrates one embodiment of the drain chain system of the invention, which is being used with a tub drain and that includes a chain that flexibly extends into the drain plumbing.

The length of the intermediate connector 130 can vary from less than 0.5 inches to one or more inches (even more than 12 or 18 inches, as shown in FIG. 4A).

The connector 130 can be connected to the chain 120 and the cap 110 by any connection means, including, but not limited to welding, adhesives, friction, mechanical clamps or clasps, knots or other connection means. The diameter of the connector 130 can be selected to be any appropriate diameter.

As indicated above, the chain 120 is detachably connected to the cap 110, so as to facilitate easy removal and replacement of the de-clogging segment of chain. In these embodiments, the connector 130 is equipped with a coupling element 150 or other connection object that operates as a detachable connection point for detachably connecting the chain 120 to the cap 110 indirectly through the intermediate connector 130.

In the present embodiment, the coupling element comprises a dual slotted receptacle that is sized and shaped to receive and hold a bead from chain 120 in one slot and a bead from chain 140 in another slot. The chain 120 can be selectably removed/detached from the coupling element 150 by pulling any bead of that chain 120 that is contained within the slot of the coupling element 150 out of the coupling element 150. Likewise, a new chain can be connected to the system 100 by placing a bead/link from the new chain into the coupling element 150.

Other types of coupling elements can also be used, some of which are described below with specific regard to FIGS. 7B-7D and 7F.

In some embodiments, the chain 120 is made from the same material as the decorative cap 110. It can be beneficial to manufacture the chain and cap out of the same material to minimize manufacturing costs in some circumstances.

In other embodiments, the chain 120 is manufactured out of a different material than the cap 110, including plastics, composites, ceramics, metals or any combination thereof. This can be beneficial, for example, to facilitate the manufacture of different types of caps to provide for marketing opportunities for decorative caps of various configurations and to accommodate different preferences and needs.

Although not required, the cap 110 can be magnetized to help retain the cap in a particular location on or proximate the drain cover. Other attachment means can also be provided on the cap, such as hooks, clamps, tines (such as tines 172), suction cups, and/or other mechanical objects that are configured to position and retain the cap over or next to a drain cover in a desired placement. These attachment means (if provided) are preferably located on the bottom surface of the cap 110.

As indicated above, hair can gather on the chain 120 when the chain 120 is positioned in a drain. The chain 120 can then be pulled out of the drain, at any desired time, by pulling up on the decorative cap 110 which is lying flat on or proximate the drain cover. The chain 120 can then be thrown away, with or without the decorative cap 110, by either leaving the chain connected to the cap 110 or by detaching the chain 120 from the cap 110. The chain 120 can be detached from the decorative cap 110 and a new chain can be attached to the decorative cap 110, such as, for example, by using coupling link 150.

FIG. 2 shows a different embodiment. In this embodiment, the drain system 200 includes a cap 210 that operates as a drain cover or that comprises a specialized cap 212 that is physically coupled to the drain cover. As before, a chain 220 is connected to the cap 210/212 with an intermediary connector 230 that has an intermediate chain segment 240 and a coupling element 250. The chain 220 in this embodiment is composed of a plurality of interlocking loops. The chain 220 can be removed by opening a loop/hook on the coupling element 250 and sliding the chain 220 off of the loop/hook. A new chain can be added by hooking a link in the new chain with the loop/hook of the coupling element 250 and by closing the hook/loop to form a closed loop (if desired).

In this embodiment, the intermediate connector 230 also includes a stem or rigid mounting point 260 that extends perpendicularly away from the bottom surface of the cap 210/212. This embodiment can be useful for helping position the cap 210/212 in a desired placement over a drain, by placing the mounting point 260 within the hold of a drain cover, for instance. This embodiment can also be useful for adding a more robust connection between the chain 220 and the cap 210/212. In some embodiments, not shown, the coupling element 250 is directly connected to the mounting point 260, without any intermediary chain 240.

The embodiment of FIG. 2 also illustrates how the cap 210 has a plurality of holes 270, as described above with regard to FIG. 1. However, in this embodiment, at least some of the holes are tapered, namely holes 275, which are configured to receive screws 280 that can mount the cap 210 over a drain. The screws 280 can be provided with the system 200, as part of a kit, or they can be obtained separately.

The embodiment of FIG. 2 can be useful for enhancing the functionality of a drain cover. In particular, the filtering functionality of a drain cover can be enhanced by equipping the drain cover with a chain that can entangle or otherwise prevent debris from going down the drain. However, maintenance of this system can involve more steps to replace the chain. In particular, when the cap 210 is screwed into place over a drain, it will be necessary to remove the screws 280 from the cap 210 before the chain can be removed and replaced.

In some embodiments, however, the cap 210 is configured to securely fit over a drain, with a friction fit or merely under the weight of gravity, without using the screws 280 to secure the cap 210 in place. In such embodiments, it is relatively easy to remove the cap 210 from the drain and to clean or replace the chain 220.

In yet another embodiment, reflected by phantom line 214 and as suggested above, a specialized cap 212 can be inserted into a modified drain cover, which is modified with a large central hole defined by line 214 and which is configured in size and shape to securely receive and couple to the specialized cap 212. For example, the specialized cap 212 can be configured to twist/screw into the modified cover (with corresponding threads in each of the modified cover and the specialized cap 212 (not shown)), for a secure fit. Or, the specialized cap 212 can simply rest against the modified drain cover via a tapered fitting or a circumferential ridge, to be held in place against the modified cover by gravity.

The specialized cap 212 can include holes 270 that match the holes 270 in the modified drain cover. Alternatively, the specialized cap 212 can omit any holes or can have a different type or configuration of holes than are present in the modified cover, so as to facilitate distinguishing the specialized cap 212 from the cover.

Although not presently shown, the specialized cap 212 can also include mechanical elements that facilitate the attachment of the specialized cap 212 to the modified cover. These elements can include any combination and configuration of slots and/or ridges that protrude into or away from the top surface of the specialized cap and that can be used to facilitate turning/screwing the specialized cap 212 into the modified cover or to facilitate grasping/lifting the specialized cap 212 away from the modified cover and without having to remove the cover or screws 280 holding the cover in place.

Figure 3:
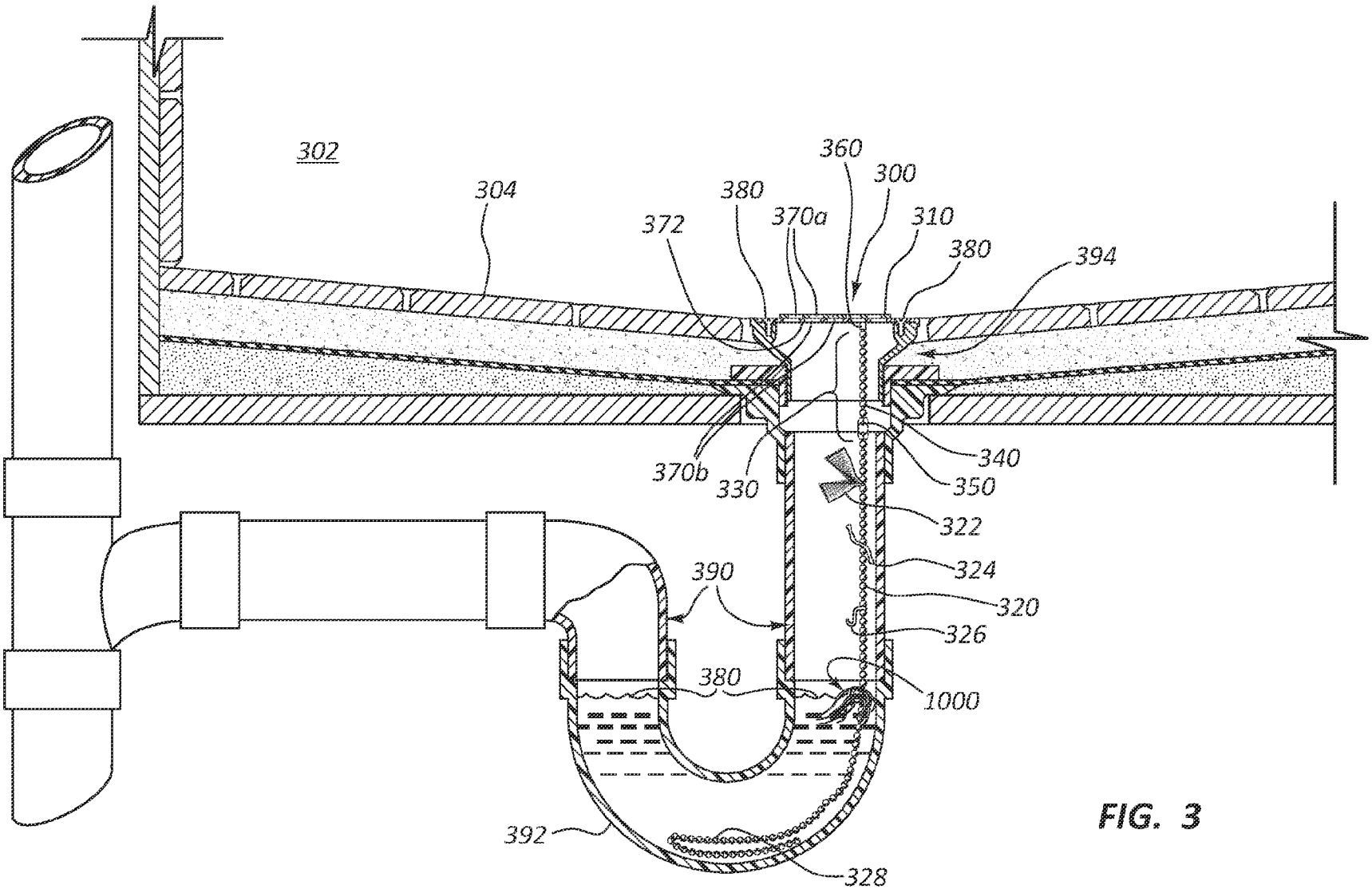
FIG. 3 illustrates one embodiment of a drain chain system with a cap that is placed on a drain cover and that includes a chain positioned through a hole in the drain cover and that extends into the drain below the drain cover.

Attention is now directed to FIG. 3, which illustrates the drain chain system 300 being used in a shower 302. In particular, the inventive system 300 is positioned over the drain cover 372 of a drain 394 that is formed into the floor 304 of the shower 302. The drain cover 372 is presently secured to the floor 304 by screws 380.

While the cap 310 covers most of the drain cover 372, water is permitted to pass through holes **370*a* in the cap 310, on through into holes 370*b* in the drain cover 372, and down into the drain 394**.

The cap 310 of the system 300 is positioned flat against the drain cover 372. This positioning occurs after the chain 320 is fed through one of the holes **370*b* in the drain cover 372. The cap 310 is at least partially held in place (e.g., vertically), by the mounting point 360 that extends perpendicularly away from the cap 310 and that is positioned through one of the holes 370*b* in the cover 372**. Additional mechanisms for holding the cap in place can also be provided (not presently shown), as described above.

Presently, the mounting point 360 is offset from a center of the cap 310. However, in other embodiments, as shown in FIG. 1, the mounting point 160 can be connected to a centrally located region on the bottom surface of the cap 110.

The de-clogging system 300 shown in FIG. 3 also includes an intermediary connector 330 that includes an intermediate chain segment 340 and a coupling element 350. As shown, the coupling element 350 and intermediary connector 330 are used to detachably connect the de-clogging chain 320 to the cap 310.

Notably, a portion 328 of the chain 320 is flexibly resting at the bottom of a p-trap 392 in the plumbing 390 of the drain 394. The flexibility of the chain 320 enables the chain to be used in a variety of different drain systems. If the chain 320 is too long, it simply gathers into a resting portion 328 at the bottom of the plumbing. This is an advantage over prior art systems that must be manufactured to different lengths to accommodate different drain lengths.

While the chain 320 can be any length, it is preferably at least long enough to reach the water line 380 of the p-trap 392 or other plumbing 390. One reason for this is because hair 1000 and other debris typically accumulate at the water level 380. It is at the water level 380 and beneath where the hair and other debris will then become entangled with the links in the chain 320.

Once the hair 1000 or other debris becomes entangled in the chain 320, the chain 320 can then be pulled up through the hole in the drain cover 372 with the entangled debris. In some embodiments, it has been found that the hair 1000 will become compressed and pull through the hole in the drain cover 372 with the chain 320, even without requiring any additional mechanisms for holding the hair in place (besides the links in the chain). Hair can often become entangled in the additional portion 328 of the chain 320 that is resting below the water level as the chain 320 is pulled out of the drain 394.

Sometimes, hair will also get caught along portions of the chain 320 that are above the water level 380 within the drain. For this reason, it is sometimes desirable to provide a coupling element 350 that is very close to the cap 310 when the cap 310 will be re-used with a new chain, so as to avoid having hair/debris to be caught by the intermediary connector 330, so as to minimize any cleaning of the intermediary connector 330. Alternatively, or additionally, the intermediate connector 330 can be shortened to a single mounting point 360, as in FIGS. 1, 6 and 8, which can be configured with a coupling element 350 directly connected to the mounting point 360, (not shown), and while omitting any intermediary connecting chain segment (e.g., segment 340). For instance, coupling element 350 can be coupled directly to mounting point 360.

Figure 5:
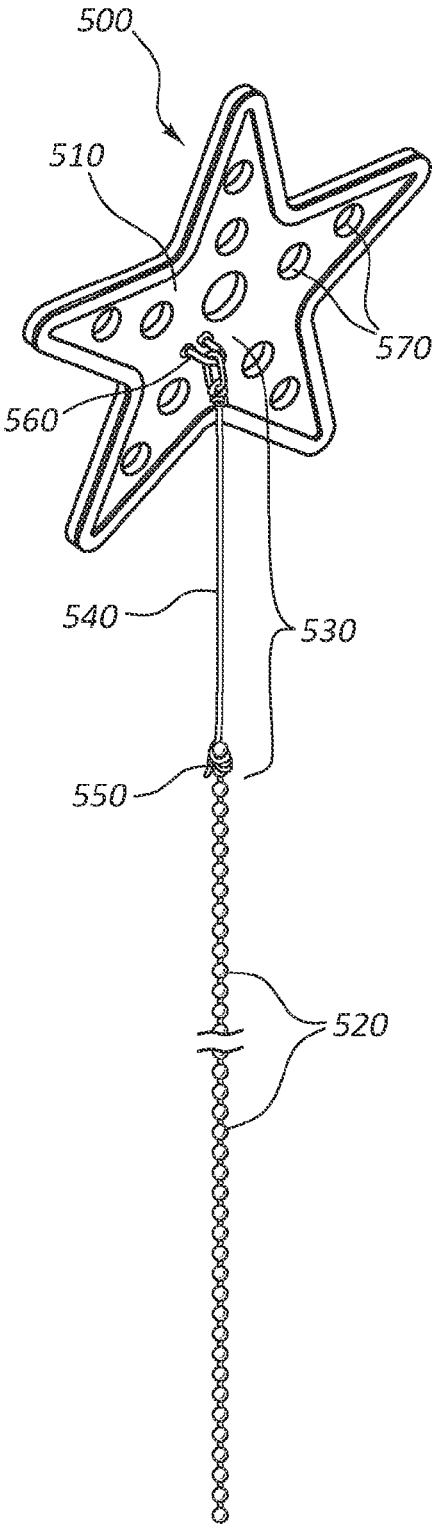
FIG. 5 illustrates one embodiment of a drain chain system that includes an intermediate segment comprising a string or wire that is interconnecting a star-shaped cap and a bead chain.
Figure 7A:
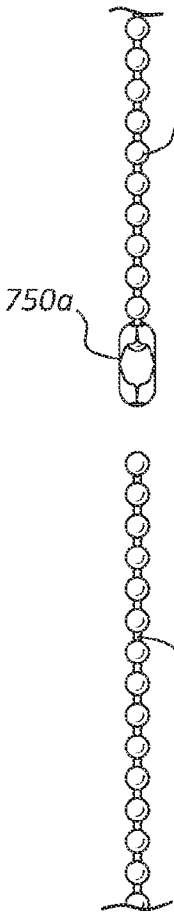
FIG. 7A illustrates one embodiment of a coupling element comprising a slotted receptacle connected to a bead link on an intermediate segment of chain, as well as another chain segment having bead links capable of being selectably/detachably coupled to the coupling element.
Figure 7B:
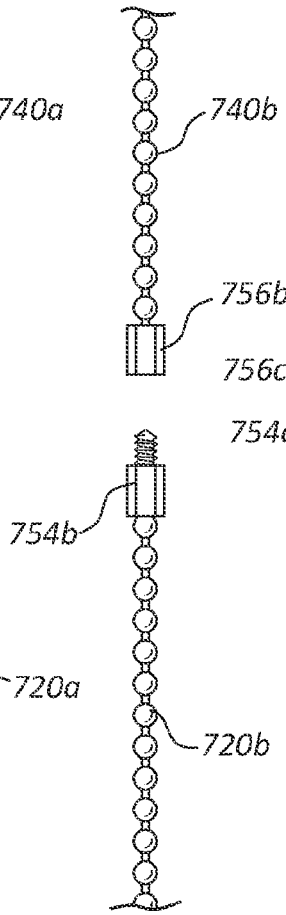
FIG. 7B illustrates one embodiment of a coupling element comprising a threaded receptacle on an intermediate segment of chain, as well as another chain segment having a threaded prong that can be threaded into the threaded receptacle.
Figure 7C:
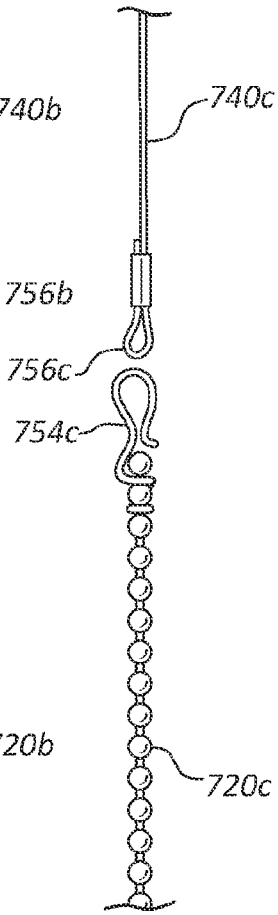
FIG. 7C illustrates one embodiment of a coupling element comprising a closed loop, on an intermediate connector, and a hook on a chain segment, which are configured in size and shaped to be selectably/detachably coupled together.
Figure 7D:
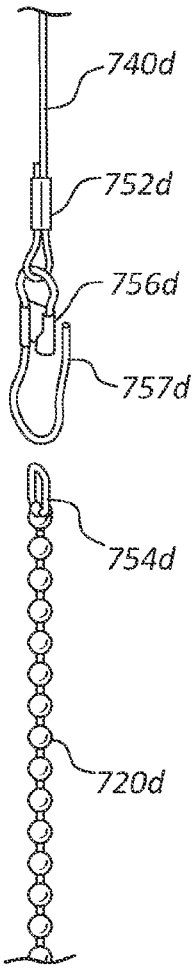
FIG. 7D illustrates one embodiment of a coupling element of an intermediate connector comprising a closed loop interconnected with an additional closed loop and hook connector, as well as a closed loop on a chain segment that is configured in size and shape to be selectably/detachably coupled together with the closed loop and hook connector.

In other embodiments, as shown in FIGS. 5, 7C and 7D, the intermediary connector can be composed of a wire, cord or other material that is not likely to catch the hair as it passes through the drain.

FIG. 3 also illustrates how the systems of the invention can be used in combination with additional interactive members that can be used to further interact with and catch hair that passes through the drain. These interactive members (322, 324, 326) are illustrated in FIG. 3 as a Velcro-type material 322 (or another hook type material), as a rubber tine 324, and as a hook 326. Other types of interactive members can also be used, which can be made of flexible or rigid materials affixed to the chain with an adhesive, a mechanical coupling (friction tie), clasps, clamps, or any other connection means. These interactive members can be positioned along the chain 320 at the anticipated water level 380 or at any other point(s) along the chain 320. These interactive members can have any desired length (e.g., less than or greater than 0.25 inches or less than or more than 1 inch). The thickness of the interactive members can also vary, from less than 0.125 inches to more than 0.25 inches.

Interactive element 222, of FIG. 2, represents another embodiment in which a net, basket or other webbing structure 223, is attached to the chain to catch hair in the drain. This interactive element 222 can be directly connected to the chain 220, for example, with the support strands 224. Alternatively, the support strands 224 can be connected to coupling element 250.

In yet another embodiment, the interactive element 222 can be indirectly connected to the chain, such that the support strands 224 are omitted. In this embodiment, the chain simply passes through the center ring 226 of the interactive element 222 and stop 225 is used to keep the interactive element from falling completely off of the chain. In this embodiment, as well as the others, the interactive element 222 can be manufactured out of a buoyant material that allows the interactive element 222 to float on the water level of the p-trap or other plumbing. The webbing structure 223 (made of metal, string, fabric, plastic and/or any other material) is operable to catch/entangle hair and other debris at the water level. Such debris can also become entangled in the support strands 224 (when present).

When desired, the chain 220 can be pulled from the plumbing and the webbing structure 223 is pulled up with the chain by way of the support strands 224 and/or the stop 225, which can be discarded and replaced when the chain is replaced.

The diameter of the interactive element 222 can vary to accommodate different needs and preferences. In some embodiments, the diameter of the interactive element 222 is greater than 1 inch or greater than 2 inches. In other embodiments, the interactive element 222 is smaller than the hole formed in a modified drain cover, such as defined by line 214, for example.

Attention will now be directed to FIG. 4A, which illustrates a drain chain system 400*a* that is positioned in use with an overflow tub drain 496*a* that is formed into the side 404*a* of a tub 402. As shown, the drain chain system 400*a* includes a chain 420*a* that is connected to an intermediate segment 430*a* by way of a coupling element 450*a*. The intermediate segment 430*a* in this embodiment comprises a chain 440*a* that is also connected to a cap 410*a*. Intermediate segment 430*a* can also comprise a string or other material. The cap 410*a* in this embodiment does not necessarily have holes formed through it and it is not necessarily flat, although it can be. The size and ornamentation of the cap 410*a* can vary to accommodate any need or preference. The cap 410*a* can also be buoyant in water or not.

This drain chain system 400*a* is positioned within the side tub drain 496*a* by feeding the chain 420 through the opening 498*a* in the drain 496*a*. The chain 420 then falls down through the drain plumbing 490*a* until it reaches the water level 480*a* of the p-trap 492*a* or other plumbing. If there is extra chain 428*a*, it can flexibly rest on the bottom of the plumbing, as shown.

As water flows out of the bottom drain 494*a* that is formed into the tub 402 floor, it will also pass by the drain chain system 400*a* that extends all the way into the p-trap 492*a* region of the plumbing 490*a*. Although not common, it is also possible to catch any hair/debris that falls through the plumbing 490*a* from overflow tub drain 496*a*. Accordingly, the drain chain system 400*a* can catch hair and other debris that goes through either drain in the tub. The chain 420*a* can then be pulled out of the drain 496*a*, at any desired time, by pulling the cap 410*a* which is held in place against the drain 496*a* by friction, by a hook (not shown), by magnets (not shown), suction cups (not shown), and/or any other attachment mechanisms connected to the cap 410*a* and that are adequate for holding the cap 410*a* in place against or near the drain and that are configured to keep the cap from passing through the opening 498*a* in the drain 496*a*.

Once the chain 420*a* is removed, it can be thrown away, with or without the decorative cap 410*a*, by either leaving the chain 420*a* connected to the cap 410*a* or by detaching the chain 420*a* and replacing it with a new chain.

FIG. 4A also illustrates how a chain system can be used with the bottom drain 294*a* of a tub, with the cap 412*a* resting on the drain cover and with the chain 422*a* passing through the plumbing 490*a* into the p-trap 492*a*. The chain 422*a* can be connected directly to the cap 412*a*, as described herein, or can be used with an intermediate segment, as also described herein.

Figure 4B:
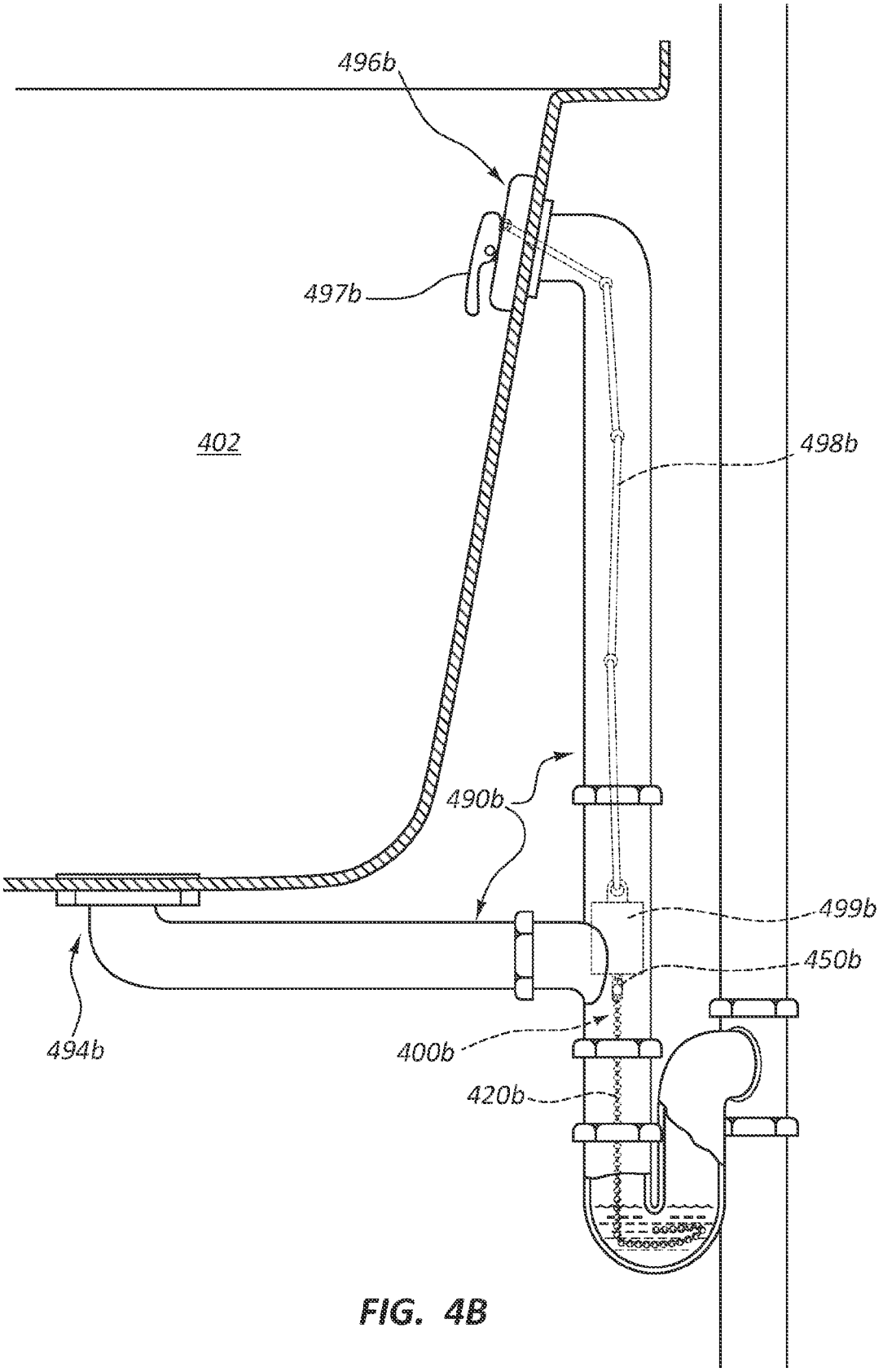
FIG. 4B illustrates one embodiment of another drain chain system of the invention, which is being used with a tub drain and that includes a chain that flexibly extends into the drain plumbing that is connected to a mechanical plug.

FIG. 4B illustrates another drain chain system 400*b* that is being used in a tub 402. However, in this system 400*b*, the chain 420*b* is connected to a coupling element 450*b* that is also connected to a drain plug 499*b*. The drain plug is operable to plug the plumbing 490*b* and to stop water from flowing out of the floor drain 494*b* when the plug is lowered into the plumbing by lever 497*b* and hinged arms 498*b* that are connected to the wall drain 496*b*. In this embodiment, the chain 420*b* can be removed from the drain 496*b* by disconnecting the lever 497*b* from the drain 496*b* and pulling the entire plug 499*b* and hinged arms 498*b* out of the drain 496*b*. Once removed, the chain 420*b* can be cleaned or replaced.

FIG. 5 illustrates another drain chain system 500 of the invention. In this embodiment, the intermediate segment 530 comprises a string or wire 540 that is interconnecting a star-shaped cap 510 and a bead chain 520. The coupling element 550 in this embodiment comprises a knot tied between an end of the wire/string 540 and an end of the chain 520. Accordingly, the coupling element 550 in this embodiment can also be viewed and include an end of the wire/string 540 and an end of the chain 520 comprising one or more of the links/beads of the chain 520.

As in many other embodiments, this system 500 also includes a mounting point or mounting member 560 that is configured to secure the intermediate segment 530 to the cap 510. In this embodiment, the cap is also formed with a plurality of holes 570. The holes 570 can be similarly sized or sized differently (as shown).

Figure 6:
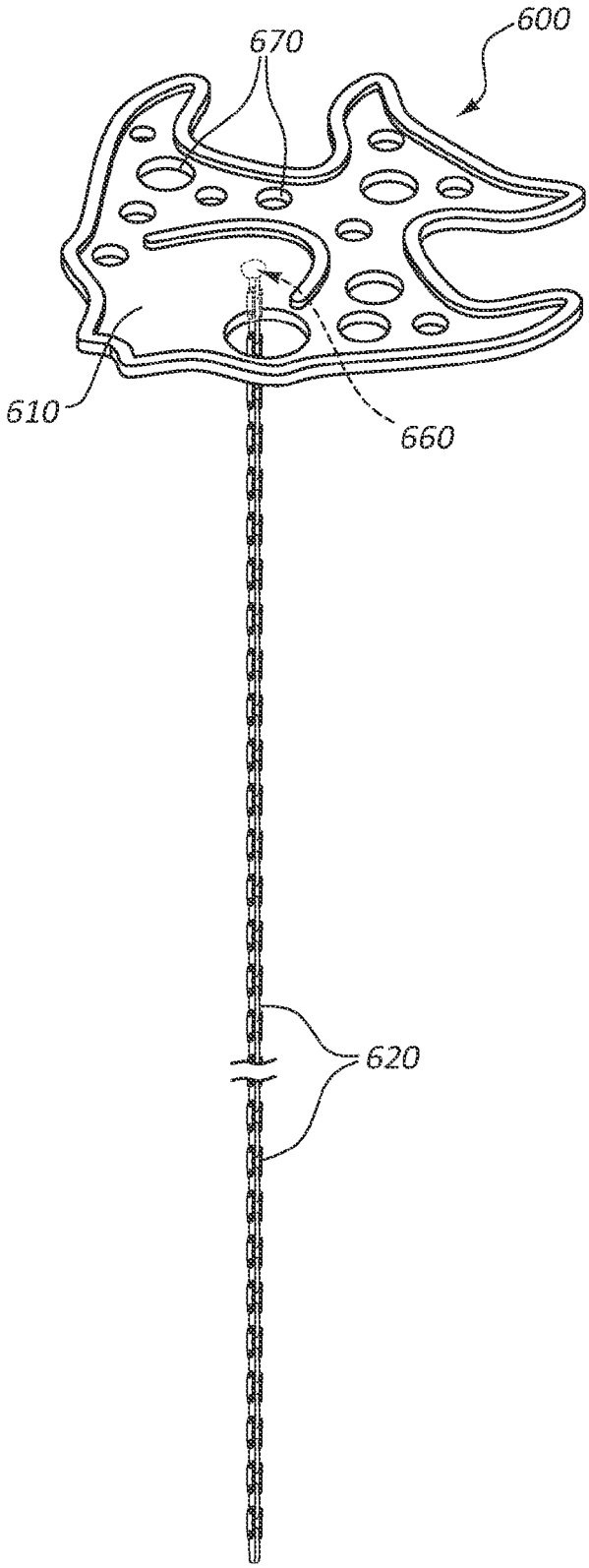
FIG. 6 illustrates one embodiment of a drain chain system that includes a chain with interconnecting links and a fish-shaped cap that is directly connected to the chain.

FIG. 6 shows a different embodiment of a drain chain system 600 that includes a chain 620 with a plurality of interconnecting loop links. This chain 620 is directly connected to a fish-shaped cap 610 at mounting point 660. Like the embodiment of FIG. 5, this cap 610 also includes a plurality of differently sized holes 670. However, unlike the embodiment of FIG. 5, this system 600 does not include an intermediate segment. This embodiment can be useful when the manufacturing of the entire system is relatively inexpensive, so that it is practical to replace the entire system 600 once the chain 620 has been pulled from a drain with entangled hair/debris.

FIGS. 7A-7F illustrate different configurations for connecting elements of the drain chain systems together. In FIG. 7A, for example, a coupling element is illustrated that comprises a dual-slotted receptacle 750*a* connected to a bead link from an intermediate segment 740*a* of chain, as well as another chain segment 720*a* having bead links capable of being selectably/detachably coupled to the coupling element.

The embodiment of FIG. 7B includes a coupling element comprising a threaded receptacle 756*b* on an intermediate segment 740*b* of chain, as well as an another chain segment 720*b* having a threaded prong 754*b* that can be threaded into the threaded receptacle 756*b* to selectably/detachably connect the lower chain 720*b* to the intermediate chain segment 740*b*.

FIG. 7C illustrates a coupling element comprising a closed loop 756*c*, on an intermediate connector 740*c*, and a hook 754*c* on a chain segment 720*c*, which are configured in size and shaped to be selectably/detachably coupled together by passing the hook 754*c* through the loop 756*c*.

FIG. 7D illustrates one embodiment of a coupling element of an intermediate connector 740*d* comprising a closed loop 752*d* interconnected with an additional closed loop and hook connector 756*d*, as well as a closed loop 754*d* on a chain segment that is configured in size and shape to be selectably/detachably coupled together with the closed loop and hook connector 756*d* by passing the hook 757*d* through the loop 754*d* on the chain 720*d*. The hook 757*d* can be latched into the body of the closed loop and hook connector 756*d*, if desired, to further secure the chain 720*d* on the loop and hook connector 756*d*.

Another coupling element, not shown, can include magnets, wherein each of the chain and the intermediate segment and/or cap have magnets.

Figure 7E:
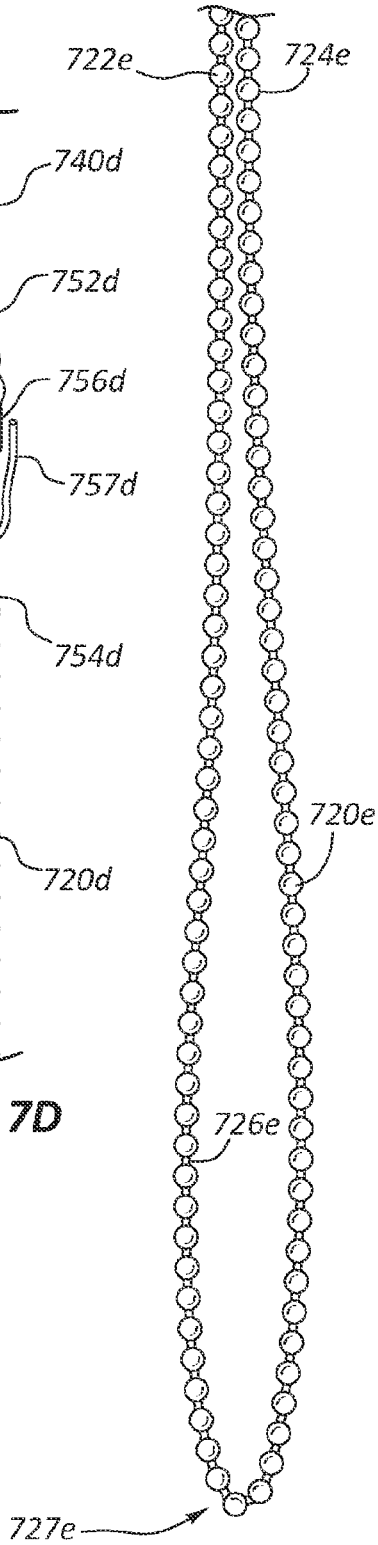
FIG. 7E illustrates one embodiment of a looped chain that can be connected to a cap or intermediate segment of the claimed devices.

FIG. 7E illustrates one embodiment of a looped chain having two strands (720*e* and 726*e*) which are connected together by links of the chain at the bottom/lower end 727*e* of the strands. The top portions (722*e* and 724*e*) of the strands can also be connected together or to a single object to form a closed loop in the chain. In particular, the top portions (722*e* and 724*e*) of the chain segments can be connected to a cap or intermediate segment of the inventive drain chain devices. This type of closed loop can be particularly useful to catch hair/debris because of the duplicated number of links, as well as the bottom 727*e* of the looped segments that forms an additional catch mechanism.

This embodiment is well suited for use with the drain chain system of FIG. 2, which does not require the chains to pass through a drain cover hole. Instead, the chains can simply be passed into the plumbing of the drain. This embodiment can also be used with the specialized cap 212, such that the chains (two or more connected or unconnected chain segments) can be connected to the bottom of the specialized cap 212, to be passed into and removed from the drain plumbing, without having to remove the modified drain cover from the drain.

Figure 7F:
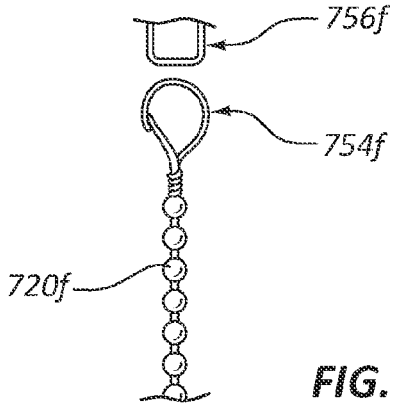
FIG. 7F illustrates one embodiment of a coupling element of an intermediate connector comprising a claw clip attached to a chain and a looped receptacle that can be connected to a cap directly or to the cap with an intermediate segment.

FIG. 7F illustrates an embodiment in which a coupling element includes a claw hook 754*f* that is configured to securely hold a loop, such as interconnecting loop 756*f*, in the hook. To remove the loop from the claw hook 754*f*, the latch in the hook must be mechanically opened first. This embodiment is useful for securely holding the chain in place and for quickly attaching one or more chains to the loop 756*f*, which can be a mounting point on the cap or a mounting element of an intermediate segment that is connected to the cap. The embodiments of FIGS. 7C and 7D can also be used to connect multiple chains at a time directly to a cap (such as the specialized cap 212) or indirectly via an intermediate segment.

Figure 8:
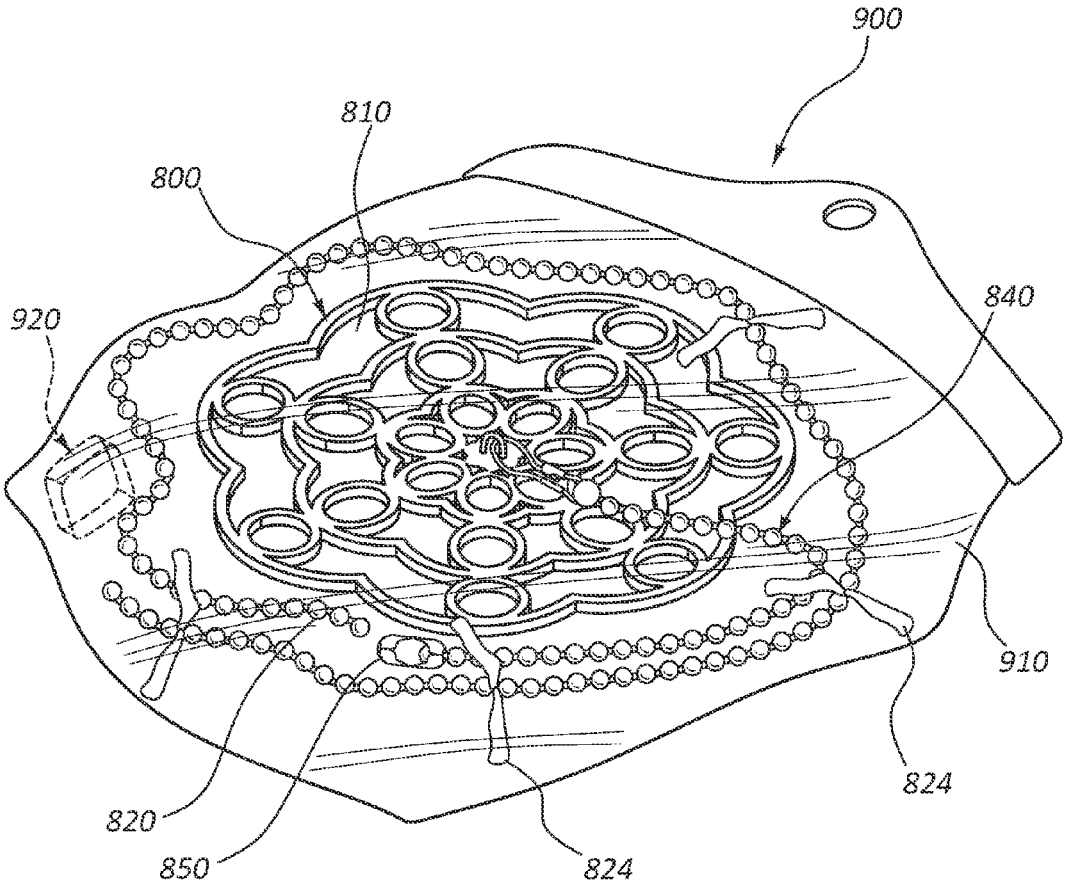
FIG. 8 illustrates a packed kit containing a decorative cap, an intermediate segment connected to the cap with a loop and hook connector and separate de-clogging chain segment. The kit can also be packaged with replacement parts and other objects.

FIG. 8 illustrates a packed kit 900 containing a drain chain system 800, including decorative cap 810, an intermediate segment 840 connected to the cap with a loop and hook connector, and separate de-clogging chain segment 820. The intermediate segment 840 also includes a coupling element 850, which can couple the chain segment 820 to the intermediate segment 840. However, in the present illustration they are not connected. In some embodiments, the chain 820 is connected to the intermediate segment 840 prior to packaging the kit 900. In other embodiments, the chain 820 is connected directly to the cap 810, omitting any intermediate segment. Presently, the chain segment includes interactive elements 824. However, these elements 824 can be omitted from other embodiments.

It should be appreciated that any combination and quantity of drain chain elements from any of the described configurations can be packaged into the kits of the invention. For instance, the packaged kit 900 can include any number of additional elements, as reflected by optional element(s) 920. In one embodiment, the optional element(s) 920 include additional chain segments that are capable of being used to replace the illustrated chain segment 820. These replacement segments can be the same as the illustrated chain segment 820 or can have different configurations.

The optional elements(s) 920 can also include different caps, intermediate segments, coupling elements, and/or entire de-clogging systems. In some embodiments, one or more of the replacement chains are packaged and sold separately from the drain chain systems and/or caps.

The optional element(s) 920 can also include instructions for using the drain chain system to clean a drain, to perform any of the functionality described herein, and/or how to obtain replacement chains.

The kit 900 is presently shown to be packaged in a transparent envelope 910. However, it will be appreciated that different types of packaging can be used to package the kits of the invention, including envelopes, bags, boxes, tubes, or any other packaging. The drain chain systems of the invention can also be sold without any external packaging.

Embodiments of the invention also extend to methods for manufacturing and methods for using the drain chain systems described herein. For instance, methods of the invention include casting, cutting or stamping the caps and attaching chains and/or intermediate connectors to the caps. The intermediate connectors and/or chains can be attached directly to the caps by an adhesive, welding, riveting, clamping, or with any other attachment methodology. The chains can also be connected to the intermediate connector, when one is used in the system. Additional engagement members, described above (e.g., 824), can also be attached to the chain. As part of the assembly, coupling elements (as described above) can also be connected to the intermediate connector and/or chain.

Methods for using the drain chain systems of the invention, which have already been described above, include obtaining a drain chain system, connecting the chain to the cap (if not already connected), either directly or indirectly with the coupling element of the cap or an intermediate connector. The chain is then put into a drain. In some embodiments, this includes feeding the chain through a drain cover hole or through an opening in a drain. In many embodiments, the chain is fed through the drain until it reaches the water level and/or p-trap of the plumbing. Then, the chain remains in the drain during use of the shower/tub. After a desired amount of time (e.g., a week or several weeks) or a desired amount of usage (e.g., a dozen uses, less than 100 uses, more than 100 uses), the chain is pulled up from the drain. The chain can be pulled from the drain, for instance, by lifting or pulling on the cap away from the drain. Then, in some embodiments, the entire system is discarded. In other embodiments, the chain is removed from the system and replaced with a new chain. The new chain is then placed into the drain and the process is repeated.

In some embodiments, additional steps are also included, such as the steps for fixedly attaching the cap to the drain when the cap is in the form of the drain cover or a modified drain cover (e.g., FIG. 2).

The present invention may be embodied in other specific forms without departing from its spirit or essential characteristics. The described embodiments are to be considered in all respects only as illustrative and not restrictive. In fact, any combination of the features disclosed in any of the foregoing embodiments can be combined. The scope of the invention is, therefore, indicated by the appended claims rather than by the foregoing description. All changes which come within the meaning and range of equivalency of the claims are to be embraced within their scope.

What is claimed is:

1. A drain chain system configured in size and shape to be at least partially placed through one of a plurality of holes in a drain cover that is positioned over a drain of a shower or tub and to position a chain within the drain during use of the shower or tub, the drain chain system comprising:

a flexible chain that is composed of a plurality of interconnecting chain elements that are configured in size and shape to pass through one of the holes in the drain cover of the drain of the shower or tub;

a cap that is connected to the flexible chain, the cap being configured in size and shape to engage the drain cover while the flexible chain is positioned within the drain, through said one of the holes in the drain cover, and in such a manner as to keep the cap from falling completely through the hole of the drain cover, the cap further being configured in size and shape to engage the drain cover without preventing water from flowing through the drain cover into the drain when the cap is positioned over the drain cover during use; and a plurality of interactive members which are distinguished from the interconnecting chain elements and which are positioned along and connected to the flexible chain, the interactive members being composed of a rubber material or a non-metal material that is different than a material of the flexible chain and interconnecting chain elements, the interactive members being configured to entangle at least some of the hair in the drain when the flexible chain is positioned within the drain.

2. The drain chain system of claim 1, wherein the interactive elements comprise rubber tines.

3. The drain chain system of claim 1, wherein the flexible chain is flexible enough to collapse upon itself under its own weight without requiring external forces to cause the collapsing.

4. The drain chain system of claim 1, wherein the flexible chain is a ball or bead chain and the interconnecting chain elements are interconnecting balls or beads.

5. The drain chain system of claim 1, wherein the interconnecting chain elements are interconnecting and closed links.

6. The drain chain system of claim 1, wherein the flexible chain and the interconnecting chain elements are composed of a plastic material.

7. The drain chain system of claim 1, wherein the flexible chain and the interconnecting chain elements are composed of a metal material.

8. The drain chain system of claim 1, wherein the flexible chain is composed of a different material than the cap.

9. The drain chain system of claim 1, wherein the cap comprises a hook configured to pass through at least one hole in the drain cover and to rest on structure of the drain cover that separates two holes of the drain cover when the chain is positioned within the drain.

10. The drain chain system of claim 1, wherein the cap comprises a body that is at least as large as the hole in the drain cover, so as to prevent the cap from completely passing through hole in the drain cover.

11. The drain chain system of claim 10, wherein the body of the cap is relatively planar and has a uniform thickness.

12. The drain chain system of claim 11, wherein the cap has a thickness of between about 0.03125 inch and about 0.1875 inch.

13. The drain chain system of claim 1, wherein the cap comprises a body having a thickness that is non-uniform.

14. The drain chain system of claim 1, wherein the cap is less than 1 inch in diameter.

15. A drain chain system configured in size and shape to be at least partially placed within a drain of a shower or tub and to position a chain within the drain during use of the shower or tub, the drain chain system comprising:

a flexible chain configured in size and shape to pass into the drain of the shower or tub, the flexible chain composed of a plurality of interconnecting chain elements that are connected in such a manner that the flexible chain has sufficient flexibility to collapse upon itself under its own weight without requiring external forces to cause the collapsing;

a cap that is connected to the flexible chain, the cap being configured in size and shape to engage at least a portion of the drain while the flexible chain is positioned within the drain and without preventing water from flowing from the shower or tub through the drain when the cap is engaged with the portion of the drain during use; and a plurality of rubber tines connected to and spaced apart along the flexible chain that are configured in size and shape to entangle at least some of the hair in the drain.

16. The drain chain system of claim 15, wherein the plurality of rubber tines are spaced apart along the flexible chain with at least five interconnecting metallic chain elements interposed between each of the rubber tines.

17. The drain chain system of claim 15, wherein the plurality of rubber tines are spaced apart along the flexible chain with at least five interconnecting chain elements interposed between each of the rubber tines.

18. The drain chain system of claim 15, wherein the plurality of rubber tines are spaced apart along the flexible chain with at least five interconnecting chain elements interposed between each of the rubber tines.

19. The drain chain system of claim 15, wherein the interconnecting chain elements are composed of a metal.

20. The drain chain system of claim 15, wherein the interconnecting chain elements comprise open hole chain links that are each interconnected to at least one other correspondingly similar open hole chain link.

* * * * *